US011143492B2

(12) United States Patent
Seung

(10) Patent No.: US 11,143,492 B2
(45) Date of Patent: Oct. 12, 2021

(54) BALLISTIC ELEMENT

(71) Applicant: IMZ S.R.L., Zane' (IT)

(72) Inventor: Illesi Matteo Hee Seung, Breganze (IT)

(73) Assignee: IMZ S.R.L., Zane' (IT)

( * ) Notice: Subject to any disclaimer, the term of this patent is extended or adjusted under 35 U.S.C. 154(b) by 56 days.

(21) Appl. No.: 16/558,422

(22) Filed: Sep. 3, 2019

(65) Prior Publication Data

US 2021/0063125 A1 Mar. 4, 2021

(51) Int. Cl.
*F42B 1/028* (2006.01)
*F42B 25/00* (2006.01)

(52) U.S. Cl.
CPC ..... *F42B 1/028* (2013.01); *F42B 25/00* (2013.01)

(58) Field of Classification Search
CPC ..... F42B 1/00; F42B 1/028
USPC ..... 102/382
See application file for complete search history.

(56) References Cited

U.S. PATENT DOCUMENTS 90,164 A * 5/1869 Gibson ..... F42B 12/22 102/493
2,263,585 A * 11/1941 Moore ..... F42B 12/48 102/334
2,796,021 A * 6/1957 Berlin ..... F42B 12/58 102/393
2,916,799 A * 12/1959 Lyon ..... B21J 5/12 86/56
3,005,406 A * 10/1961 Ronfeldt ..... F42B 12/44 102/365
3,613,586 A * 10/1971 Talley ..... F42B 12/26 102/476
4,113,130 A * 9/1978 Lazenby ..... B64D 37/12 220/4.15
5,160,803 A * 11/1992 Fulchiron ..... F42B 12/44 102/229

* cited by examiner

*Primary Examiner* — Samir Abdosh
(74) *Attorney, Agent, or Firm* — Francis C. Hand; Carella, Byrne, Cecchi, Olstein, Brody & Agnello

(57) ABSTRACT

The ballistic element is made with a main body of non-metallic material, such as, from filaments of glass, aramid, carbon and basaltic fibers. The ballistic element also has heads of metal at opposite ends of the main body. A tubular liner of plastic may be disposed with the main body about an axial cavity for a detonating charge. The main body may also have one or more inserts for receiving one of an anchor bolt and a suspension component of an aircraft for use of the element as an aircraft bomb.

11 Claims, 3 Drawing Sheets

BALLISTIC ELEMENT

This invention concerns a ballistic element. More particularly, this invention relates to a ballistic element for limiting collateral damage or for reducing close range danger.

BACKGROUND

Many ballistic elements are known, among which some are equipped with a detonating charge.

These elements normally include a main metallic body defining a chamber housing a detonating charge as well as a front head, a rear head and two fuses, each located next to the respective head.

Once these ballistic elements strike a target, they become fragmented generating a plurality of shrapnel or fragments that cause considerable collateral effects.

It is an object of the invention to provide a new ballistic element.

It is another object of the invention to provide a ballistic element that will cause less collateral damage compared with known ballistic elements.

It is another objet of the invention to provide a ballistic element that is resistant.

BRIEF DESCRIPTION OF THE INVENTION

Briefly, the invention provides a ballistic element comprising a main body made completely in a composite non-metallic material and a pair of heads, for example of metal.

The main body is constructed to have a lateral wall of tubular configuration defining an axial cavity delimiting a housing area for receiving an internal charge, at least one strengthening rib on the lateral wall and two terminal sections, each of which is disposed at a respective extremity of the lateral wall. In accordance with the invention, the main body is made of a filament wound material, such as a material made of at least one of glass, aramid, carbon and basaltic fibers.

Each head is attached to a respective terminal section of the main body.

The ballistic element also has a tubular liner, for example of a plastic, within the main body and circumferentially about the axial cavity for the internal charge.

The main body may also have at least one insert in an outer surface defining an anchoring area for receiving one of an anchor bolt and a suspension component of an aircraft so that the ballistic element may be used as a bomb.

These and other objects and advantages of the invention will become more apparent from the following description taken in conjunction with the accompanying drawings wherein.

In the attached drawings, equivalent parts or components are distinguished by the same reference numbers.

DETAILED DESCRIPTION

Figure 1:
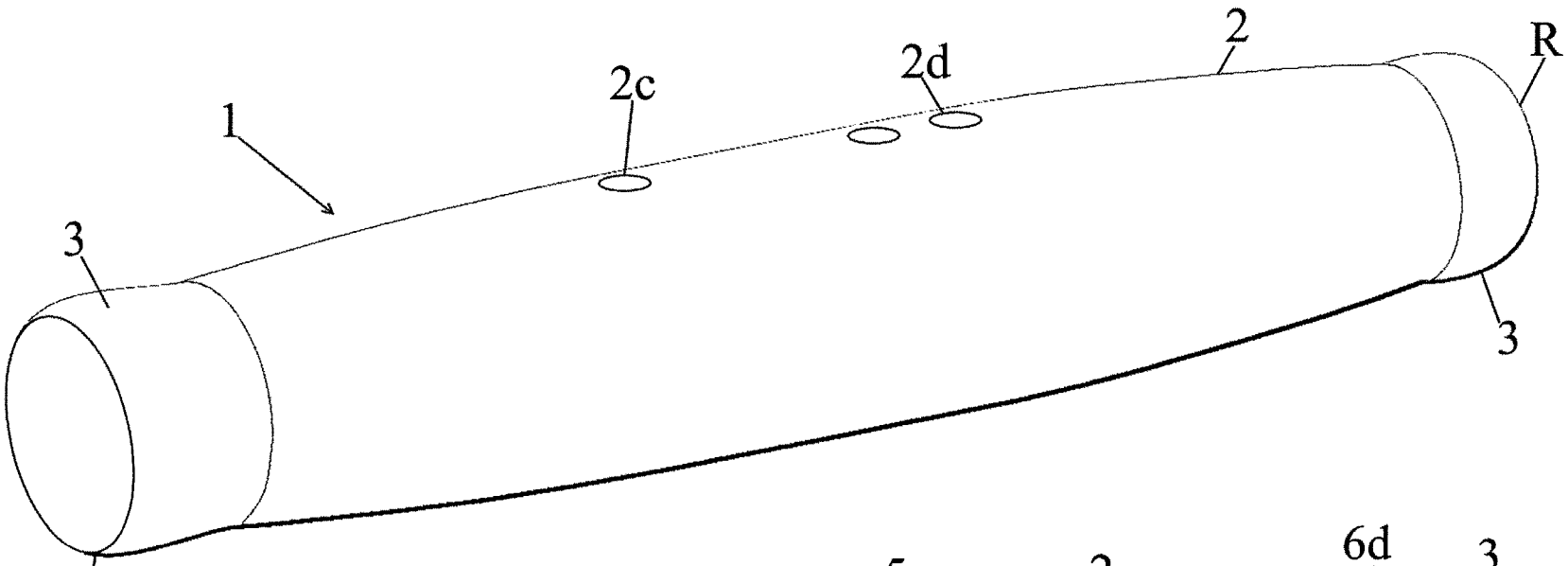
FIG. 1 is a slightly slanting perspective top view of a ballistic element according to this invention.

With reference to the attached figures, a ballistic element 1 is illustrated in accordance with this invention.

A similar ballistic element 1 can consist of a bomb, such as an aircraft bomb, for example, with reduced collateral damages or a weapon with very low collateral damage (VLCDW), or even a penetrator bomb or a bomb capable of causing considerable collateral damages.

In this patent application, the term "ballistic element" identifies an object launched by firearms or released through self-propelling carriers, for example aircraft or military vehicles.

More specifically, ballistic element 1 consists of main body 2 with a lateral wall 2*a* in hollow tubular configuration or defining an axial cavity AC, as well as two terminal sections 2*b* (see FIG. 2) each corresponding with a respective extremity of lateral wall 2*a*.

The lateral wall 2*a* can be cylindrical or even domed, in order to present a greater diameter or cross-section in the central part or section which gradually reduces as it gets closer to terminal sections 2*b*. More specifically, lateral wall 2*a* can present a central part with an essentially constant diameter, a front section or nose cone with a tapered section nearing front F and a tail part with reducing diameter nearing rear R.

Furthermore, the ballistic element 1 includes two heads 3 with, for example, one or both in metal, such as steel or tungsten, each fastened directly to a respective terminal section 2*b*.

In use, a head or point defines the tip or front F of ballistic element 1, while the other head or controller defines the tail or rear R of ballistic element 1. The tip or front F is the front end of ballistic element 1 when launched against a respective target, i.e. that which usually impacts the target first.

Furthermore, the ballistic element 1 delimits at least one housing area HZ for an internal detonating or exploding charge (not illustrated).

Preferably, at least one head 3 of the ballistic element 1 delimits at least one positioning area (not shown) for triggering or firing devices or at least one fuse (not illustrated) for the triggering or firing of the internal or detonating charge in the housing area HZ. The triggering devices or fuse(s), if envisaged, are clearly part of the element 1.

The ballistic element 1 or better still the respective housing area HZ presents a capacity for the detonating charge equal to that of traditional ballistic elements.

Moreover, the ballistic element or bomb 1 also includes other components normally used in bombs proposed so far.

As is known, when a head 3 of the ballistic element 1 strikes or impacts a target, the impact propagates through to the respective fuse or triggering devices, which following this, in turn trigger the detonating charge determining the explosion of the ballistic element 1.

Figure 2:
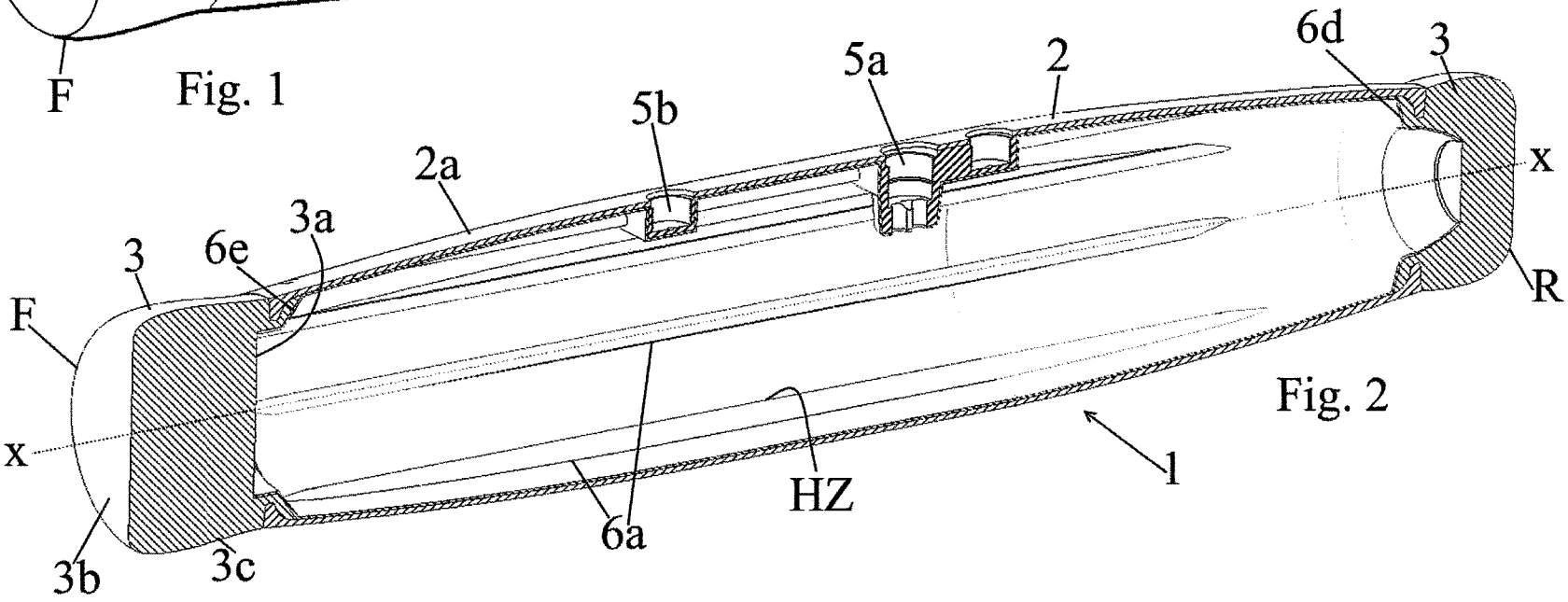
FIG. 2 is a section view along the longitudinal plane of the ballistic element shown in FIG. 1.

Referring to FIG. 2, the ballistic element 1 can comprise one, two or more inserts 5*a*, 5*b*, e.g. of metal, for the fastening, for example, via a screw-in type fastening, of the ballistic element 1 as an airplane bomb to components or suspension rings in an aircraft.

In this case, the lateral wall 2*a* can define an opening 2*c*, 2*d* for the connection of a component or suspension ring to an insert 5*a*, 5*b* or define an access to an attachment point AZ defined by an insert 5*a*, 5*b*.

Preferably, the main body 2 or, better still, the respective lateral wall 2*a* entirely enfolds the inserts 5*a*, 5*b* or the face of these aimed away from the housing area HZ, except for the openings 2*c*, 2*d* for the connection or access to the attachment point AZ. Basically, as a preference, the main body 2 constitutes a binding or holding component for the inserts 5*a*, 5*b*.

Furthermore, the lateral wall 2*a* can at least define an opening (not shown) for the positioning of a specific feeding nozzle for the detonating charge in the housing area HZ.

Moreover, as a preference, the main body 2 can be made in a single piece, entirely in composite material, in particular through the so-called "filament winding" process or continuous filament winding process.

For example, the filament or filaments can be glass, aramid, carbon or basaltic fibers. The filaments' fibers are impregnated in any suitable way, particularly by means of a fluid or resin which, following polymerization or hardening or solidification, guarantees the adhesion of the filaments or bits of filaments to each other. The hardening fluid or resin can be applied to the filament or filaments before or after the continuous filament or filaments have been wound. The composite material of the main body can therefore comprise glass, aramid, carbon or basaltic fibers with hardening resin or fluid.

Figure 4:
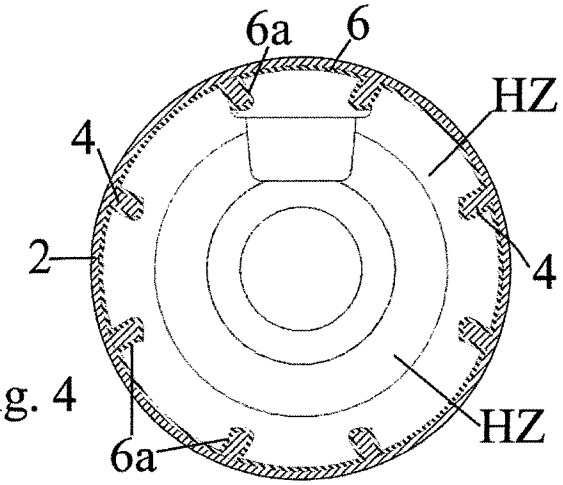
FIG. 4 is a section view of the transversal plane of the ballistic element in FIG. 1.

Referring to FIG. 4, the main body 2 is furthermore equipped with at least one stiffening rib or ridge 4 on the lateral wall 2*a*.

As regards this, the lateral wall 2*a* develops, as a preference, around a main longitudinal axis x-x, which in fact corresponds to the front F-rear R axis of the ballistic element 1. Each rib 4 substantially extends parallel to the axis x-x or, in any case, in a longitudinal direction of the front F or rear R, or in the direction from the front F to the rear R even if not parallel to the x-x axis.

As an advantage, one or more ribs 4 present a rectilinear development.

Preferably, the main body 2 includes a rotation solid with multiple diameters or transversal sections around a symmetry axis which, when in use, corresponds to axis x-x. As an example, the main body 2 has a transversal circular section.

The ballistic element 1 may include multiple stiffening ribs 4, such as three, four, five, six, seven, eight or more, for example, with each one equally distanced angularly from the other around the longitudinal main axis x-x or, in any case, distributed in a substantially uniform way around the axis x-x along the internal surface 2*e*.

In this regard, according to the example illustrated in FIG. 4, each rib 4 develops between two ribs 4 adjacent to it and is at a first angular distance from one of said adjacent ribs 4, and at a second angular distance from the other of the respective adjacent ribs 4, lesser, for example, by ½ and ⅔ of the first distance.

To take full advantage, the ribs 4 extend inwardly from the internal surface 2*e* towards the interior, i.e. towards the interior of axial cavity AC and, in use, of the casing area HZ. Alternatively, the ribs 4 extend externally form the lateral wall 2*a* outwardly towards the outside.

According to a variant, only transversal ribs are provided, or only ribs perpendicular to the main longitudinal axis x-x.

In another variant, a spiral shaped or circular rib(s) may be provided.

One, some or each rib 4 can have a thickness or height, i.e. the distance between the attachment point or connection to a surface (if wished, internal 2*e*) of main body 2 and the respective free or distal end from said surface (if wished, internal 2*e*) approximately between 5 and 150 mm, for example between 5 and 50 mm or between 70 and 150 mm.

Moreover, one, several or each rib 4 can be between 5 mm and 150 mm wide, for example between 5 and 50 mm or between 70 and 150 mm, with their direction varying from front F to rear R.

Each rib(s) 4 can be tapered away from a respective surface of the main body 2.

Preferably, the ribs 4 are made in a single piece with the main body 2, by filament winding if so wished, although the ribs 4 could also be constructed with other procedures, even built separately and subsequently fastened to a surface, for example internal 2*e* of the main body 2.

Some or all of the ribs 4 can have a radial development, meaning that they either intercept the main axis x-x, or do not intercept the main axis x-x.

As an example, two ribs 4 adjacent and subsequent, for example at a second angular distance, or a further pairs of ribs 4 can be inclined, so that the respective continuation will intersect at a point either closer or further away from them in relation to longitudinal axis x-x.

The rib(s) 4 extend from the rear section or proximal to the rear R of the element 1 up to an intermediate position at a predetermined distance from the front F of the element 1 itself and from a respective head 3.

Either insert 5*a*, or 5*b* or both can delimit at least one hollow or hollowed area 5*c* (FIG. 3) for housing a section of a respective rib 4, so that the rib 4 acts or presses against at least one wall of an insert 5*a*, 5*b* delimiting the hollow or hollowed area 5*c*.

For this purpose, the hollow or hollowed area 5*c* can be delimited on a section of the insert's edge. The hollow or hollowed area 5*c* can be through-passing as well as, for example, aligned to a rib 4.

Preferably, each insert 5*a*, 5*b* includes two hollows or hollowed areas 5*c*, each for the housing of a section of the respective rib 4. In this case, the two hollows or hollowed area 5*c* are delimited on respective opposite sections of the edge of an insert 5*a*, 5*b*.

Moreover, one of each of the hollows or hollowed areas 5*c* can at least be delimited by a wall 5*d* of the insert 5*a*, 5*b* that can be substantially radial, meaning that the wall 5*d* intercepts the main axis x-x or also that the wall 5*d* does not intercept main axis x-x.

The wall 5*d* can have a different development, for example even substantially parallel to the axis x-x and, in use, meaning that when the ballistic element or bomb is fastened to a vehicle, such as an aircraft, substantially horizontal.

If multiple inserts 5*a*, 5*b* are envisaged, each hollow of an insert 5*a*, is preferably aligned with a hollow in the other insert/s 5*b*, so that a similar rib 4 is inserted in a hollow 5*c* of an insert 5*a* and in a hollow 5*c* of another insert or other inserts 5*b*.

Figure 3:
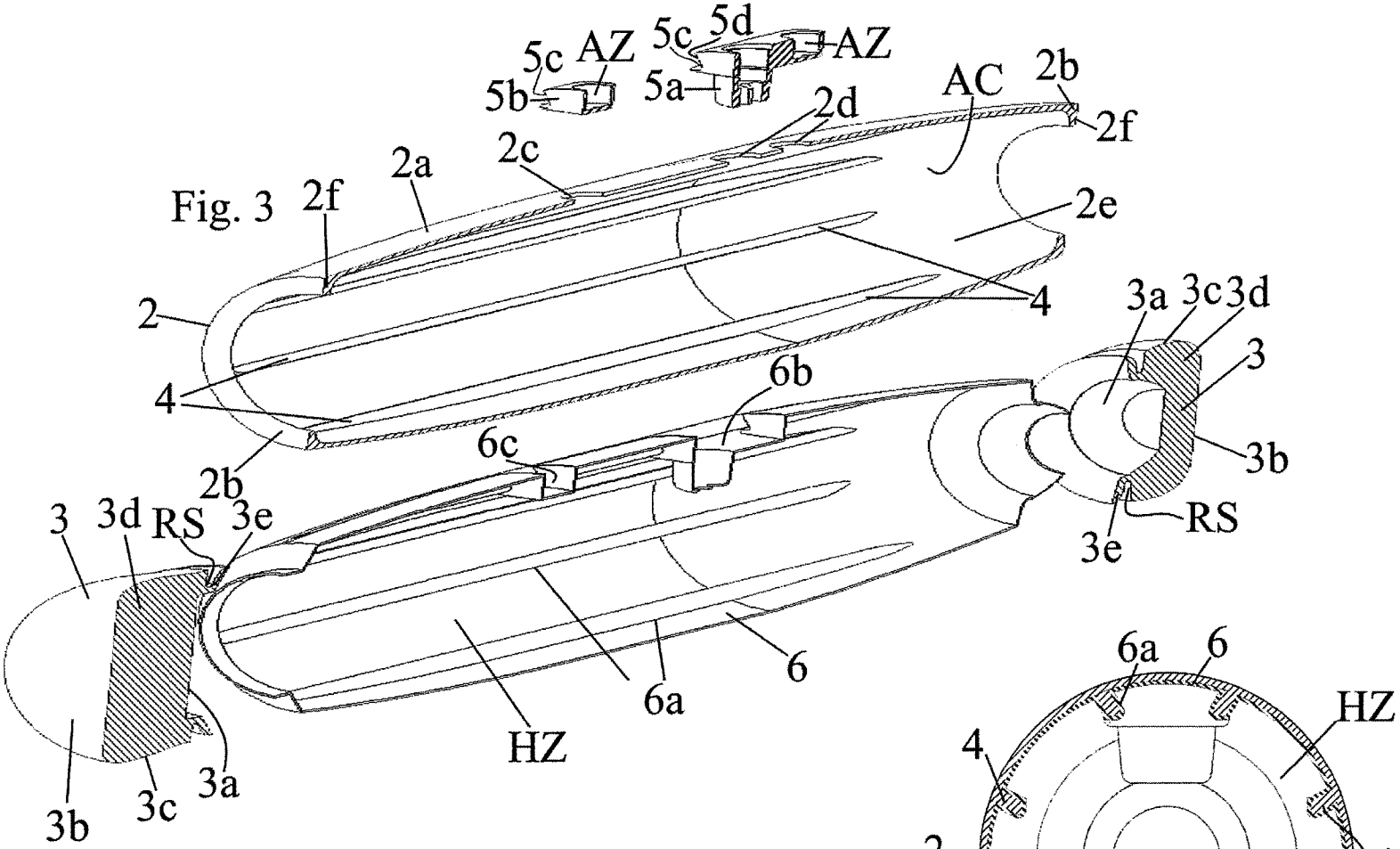
FIG. 3 is a section view of the object in FIG. 1 with the components separated.

According to FIG. 3, each insert 5*a*, 5*b* presents two hollows or hollowed areas 5*c*, each delimited by an inclined wall 5*d*, the two inclined walls 5*d* being radially developed, meaning that they intercept the main axis x-x or do not intercept the main axis x-x and are preferably inclined in such a way that their respective continuation intersects at a point nearer to or further away from them in relation to longitudinal axis x-x.

Two adjacent and successive ribs 4 are then envisaged, developed parallel to inclined walls 5*d* for example, and each housed in a respective hollow or hollowed area 5*c* in such a way that the ribs 4 act on or press against the inclined walls 5*d*, thus in fact making the insert 5 to ribs 4 connection and therefore the insert 5 to main body 2 connection substantially traction and compression-proof.

In particular, if two ribs 4 are envisaged as explained above, these press in a direction one towards the other and towards the external face in use of the insert 5*a*, 5*b*.

This arrangement, particularly where the ballistic element 1 is an aircraft bomb, guarantees a very stable and strong tie between the inserts 5 and main body 2 and therefore between the main body 2 and the aircraft since it is impossible to weld the main body 2 (in composite material) to the inserts 5 (usually metallic), Regarding this, as is known, an aircraft bomb is fastened to the aircraft by suspension eye-bolts and is furthermore braced to ensure a solid attachment with the aircraft. During flight, the bomb is therefore subjected to considerable stresses which must be countered by specific measures, such as the one described above.

Referring to FIG. 3, as regards the attachment of each head 3 with the main body 2, each head 3 can at least delimit a recess or groove RS, for example annular, whereas a respective terminal section 2*b* presents an outwardly extending section 2*f*, for example an engaged annular protrusion, possibly in the shape of the recess RS for fitting into the recess RS.

Each annular protrusion 2*f* can extend from the lateral wall 2*b* towards the interior or towards the main axis x-x.

In this way, structural integrity is obtained or a stable interlocking between the components of the element 1, as if they had been created in one single piece. Once connected, the various components cannot therefore move around in relation to one another.

Clearly, the heads 3 could be fastened to the main body 2 in a different way, even by means of a joint, snap coupling or similar methods.

Each head 3 includes an internal face 3*a*, an external face 3*b* as well as a face or edge section 3*c*, preferably annular, whose edge section 3*c* extends between the internal face 3*a* and the external face 3*b*. Preferably, the external faces 3*b* of the heads 3 constitute the two main faces, in use, i.e. the front and rear of the ballistic element 1.

Furthermore, each head 3 can consist of a solid element rotated around a symmetry axis which, in use, corresponds to axis x-x.

Furthermore, as already specified for edge section 3*c* of one or both heads 3, at least a recess or grooving or slot RS gets formed, for example annular; in the specific case where the recess RS is annular, this is substantially coaxial to the main longitudinal axis x-x, or extends around the longitudinal axis x-x. Clearly, the recess RS need not be annular, but may present one or more sections or segments, possibly curved, aligned or not, along an annular area.

The recess or grooving or slot RS, preferably opens outwards or in any case at a distance from the housing area HZ.

As regards this, on approaching housing area HZ or from the exterior to the interior, one or both heads 3 can present a main block 3*d* as well as a jutting section 3*e*, which could be annular, which delimits or in which is formed the recess or grooving or slot RS.

The main body 2, as explained further on, can furthermore be formed directly on the heads 3, namely by doing the winding in contact with or directly on the heads 3.

The main body 2 or, rather the respective terminal sections 2*b* enfold the section of the edge 3*c* of both heads 3, so as to engage and at least partially fill the respective recess or grooving RS thus firmly attaching the main body 2 to the heads 3, advantageously solely through the engagement between the recess or grooving RS and a respective terminal section 2*b* of the main body 2.

Advantageously, but not necessarily, the recess or grooving RS gets filled and engaged fully by the main body 2, namely, from an internal side to the other external side and from the bottom to the top, with this meaning that the main body 2 or, better still, the respective terminal sections, extend for the whole width of the recess RS, both in the direction of the axis x-x and transversally or perpendicularly to the axis x-x.

The engagement of terminal sections 2*b* or, rather, the jutting sections 2*f* in the recess or grooving RS of each head 3 guarantees that the attachment or grip of the main body 2 on both heads 3, is stable and well distributed as well as simple and quick to carry out. If desired, this allows the attachment between the heads 3 and main body 2 to be obtained without needing to apply other fastening components, such as rings or clamps or fastening layers between said elements, although, as is understandable, glue or an adhesive could be applied between the heads 3 and the body 2.

Each head 3 can be in a single piece, namely a monoblock, or in two or more parts or components.

Referring to FIGS. 3 and 4, the ballistic element 1 includes a liner or internal core 6, which could made of plastic, for example in high-density polyethylene (HDPE), which would cover the internal surface 2*e* of the tubular main body 2, so that the main body 2 can be insulated from the detonating charge (not shown) of the ballistic element 1.

Figure 5:
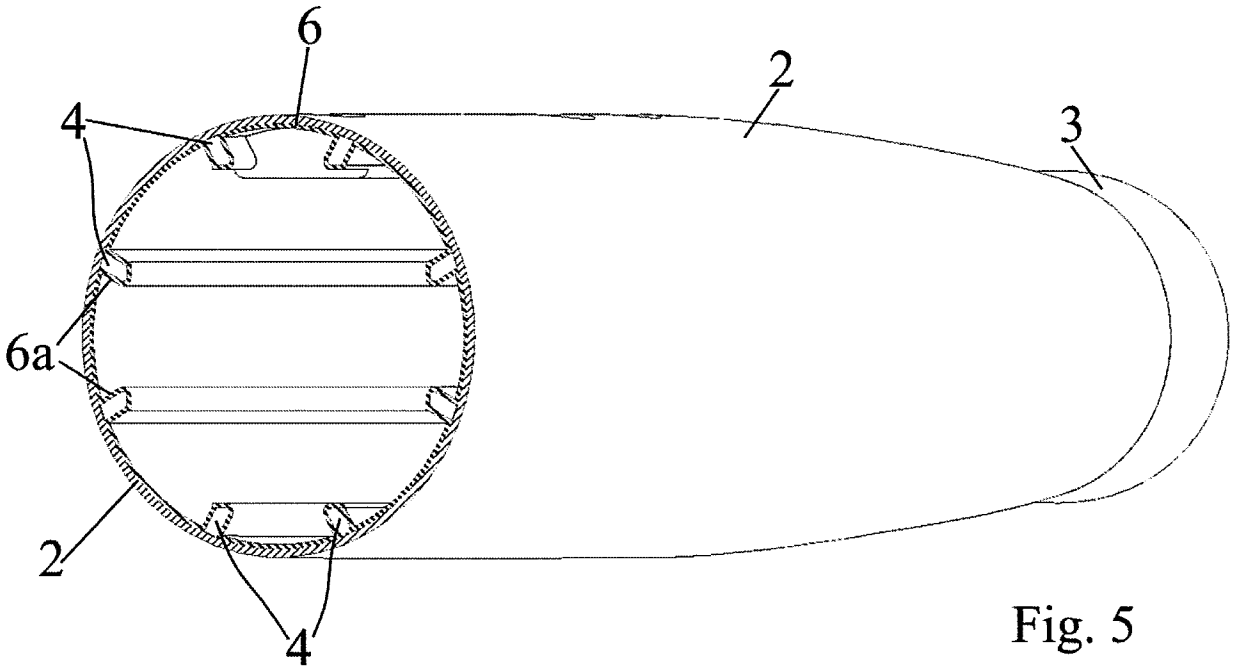
FIG. 5 is a perspective section view of the ballistic element parts in FIG. 1.

Referring to FIGS. 3, 4 and 5, the liner 6 is of tubular shape with multiple diameters or transversal sections. The liner 6 has a plurality of longitudinal sections 6*a* hollowed in a U or V shape, or in any case of a shape complementary to the ribs 4 which, in use, are housed in and whose shapes in fact engage the hollowed sections 6*a*.

The liner 6 also has a pair of seats 6*b*, 6*c* to fit the respective inserts 5*a*, 5*b*.

During assembly of the ballistic element 1, the heads 3 are abutted against the ends of the liner 6. After having engaged the heads 3 against the liner 6, the heads 3 are engaged with a spindle, and the inserts 5*a*, 5*b* are introduced (if used) in the seats 6*b*, 6*c*. The main body 2 is then created directly by means of a filament winding on the heads 3 and on the liner 6 and, if used, on the inserts 5*a*, 5*b*, that is, by doing the winding in contact or directly on the heads 3 and on liner 6. Naturally, other procedures to obtain this can be envisaged.

The inner liner 6 can also encase the internal part of the face 3*a* of at least one of the heads 3.

More particularly, the inner liner 6 adheres to the internal surface 2*e* of the main body 2 and to the part of the internal face 3*a* of the heads 3 and therefore presents an external face complementary to the inner surface 2*e* and, possibly to part of the inner face 3*a*.

Referring to FIG. 2, the liner 6 has an extremity 6*d*, 6*e* at each respective end that is shaped to enfold, from within a respective heads 3, in particular, part of the inner face 3*a*, and more particularly part of the internal face 3*a* defined by the jutting part 3*e*.

As can be understood, a ballistic element conforming to this invention can imply less collateral damage as opposed to traditional launching objects, since it mainly consists of composite material, which on impact does not generate fragments such as in the case of metal.

Instead, in the case in which a ballistic element, according to this invention, consists of a bomb intended to cause considerable collateral damages, then it can be charged with small balls or cubes or small fragments intended to be launched into the bomb's target area and to increase its fragmentation.

In this case, specific positioning spaces for the balls or small pieces can be envisaged. These spaces can be delimited by secondary hollowed sections similar to the first longitudinal sections but, in use, not filled or in any case whose shapes do not engage with respective the ribs 4.

The presence of ribs 4, furthermore, in particular for a development substantially parallel to axis x-x guarantees the high resistance of the main body 2 and therefore of the ballistic element 1, and more specifically a resistance comparable with that of meant for launching, with a principally metallic main body.

A ballistic element according to this invention can also function as a penetrator, that is, as an element or bomb that can penetrate even very thick walls (such as those of bunkers) before the charge detonates.

Due in particular to the presence of the ribs, the ballistic element has a very strong structure, thus being able to withstand stresses particularly during transport.

Moreover, a ballistic element according to this invention has the same ballistic features, such as center of gravity and moment of inertia, of traditional ballistic elements, for example, the aircraft bombs MK81, MK82, MK83 and MK84.

What is claimed is:

1. A ballistic element comprising a main body made completely in a composite non-metallic material having a lateral wall of tubular configuration developed around a longitudinal main axis of said main body and defining an axial cavity delimiting a housing area for receiving an internal charge, at least one strengthening rib on said lateral wall extending substantially longitudinally of said axis and two terminal sections, each said terminal section being disposed at a respective extremity of said lateral wall; and a pair of heads, each said head being fastened directly to a respective terminal section of said main body.

2. A ballistic element according to claim 1 wherein said at least one rib extends parallel to said axis.

3. A ballistic element comprising a main body made completely in a composite non-metallic material having a lateral wall of tubular configuration developed around a longitudinal main axis of said main body and defining an axial cavity delimiting a housing area for receiving an internal charge, a plurality of strengthening ribs on said lateral wall uniformly distributed around said axis, and two terminal sections, each said terminal section being disposed at a respective extremity of said lateral wall; and a pair of heads, each said head being fastened directly to a respective terminal section of said main body.

4. A ballistic element comprising a main body made completely in a composite non-metallic material having a lateral wall of tubular configuration defining an axial cavity delimiting a housing area for receiving an internal charge, at least one strengthening rib on said lateral wall and two terminal sections, each said terminal section being disposed at a respective extremity of said lateral wall; and a pair of heads, each said head being fastened directly to a respective terminal section of said main body wherein each said head has a recess and each said terminal section has a protruding section engaged within said recess of a respective head.

5. A ballistic element according to claim 4 wherein said recess in at least one of said pair of heads is an annular recess and said protruding section of a respective terminal section is of annular shape.

6. A ballistic element according to claim 1 wherein at least one of said heads is made of metal.

7. A ballistic element comprising a main body made completely in a composite non-metallic material having a lateral wall of tubular configuration defining an axial cavity delimiting a housing area for receiving an internal charge, at least one strengthening rib on said lateral wall and two terminal sections, each said terminal section being disposed at a respective extremity of said lateral wall;

a tubular liner within said main body and circumferentially about said axial cavity; and a pair of heads, each said head being attached to a respective terminal section of said main body.

8. A ballistic element according to claim 1 further comprising at least one insert in an outer surface of said main body having an anchoring area for receiving one of an anchor bolt and a suspension component of an aircraft.

9. A ballistic element according to claim 8 wherein said lateral wall entirely enfolds said at least one of said insert except for said anchoring area thereof.

10. A ballistic element according to claim 8 wherein an end of said at least one strengthening rib abuts said at least one insert.

11. A ballistic element comprising a main body made completely in a composite non-metallic material having a lateral wall of tubular configuration defining an axial cavity delimiting a housing area for receiving an internal charge, at least one strengthening rib on said lateral wall and two terminal sections, each said terminal section being disposed at a respective extremity of said lateral wall;

a pair of heads, each said head being fastened directly to a respective terminal section of said main body, and at least one insert in an outer surface of said main body having an anchoring area for receiving one of an anchor bolt and a suspension component of an aircraft, wherein said lateral wall entirely enfolds said at least one insert except for said anchoring area thereof.

* * * * *